US005737779A

United States Patent [19]

Haddock

[11] Patent Number: 5,737,779

[45] Date of Patent: Apr. 14, 1998

[54] HAND HELD MOVABLE URINAL ASSEMBLY

[76] Inventor: Robert H. Haddock, 345 "K" St., P.O. Box 432, Penrose, Colo. 81240

[21] Appl. No.: 530,058

[22] Filed: Sep. 19, 1995

[51] Int. Cl.[6] ..... E03D 13/00

[52] U.S. Cl. ..... 4/301; 4/341

[58] Field of Search ..... 4/301, 311, 340, 4/341, 342, 262–266

[56] References Cited

U.S. PATENT DOCUMENTS

| | | | |
|---|---|---|---|
| 3,500,480 | 3/1970 | Michal, Jr. | 4/341 X |
| 4,137,579 | 2/1979 | Soler | 4/311 |
| 5,390,374 | 2/1995 | Hubrig et al. | 4/301 |

FOREIGN PATENT DOCUMENTS

| | | | |
|---|---|---|---|
| 0029038 | 3/1977 | Japan | 4/301 |

*Primary Examiner*—Robert M. Fetsuga
*Attorney, Agent, or Firm*—Phillip A. Rein

[57] ABSTRACT

A hand held movable urinal assembly which can be readily attached to a conventional toilet bowl assembly. The hand held movable urinal assembly includes 1) a flush fluid supply assembly readily connected to a main float valve assembly to receive a flushing fluid therefrom; 2) a movable funnel receiver assembly connected to the flush fluid supply assembly through a fluid discharge line; and 3) a discharge fluid flush assembly connected to the movable funnel receiver assembly having a discharge hose member to transfer fluid to a base reservoir member on the toilet bowl assembly. The movable funnel receiver assembly includes a funnel receiver member having a main body member with a funnel enclosure lid member pivotally connected thereto. The main body member is connected to the discharge hose member to transfer fluids for discharge with normal waste products during a toilet bowl flushing operation.

5 Claims, 2 Drawing Sheets

HAND HELD MOVABLE URINAL ASSEMBLY

PRIOR ART

A patent search on this invention revealed the following United States patents:

| U.S. Pat. No. | Invention | Inventor |
|---|---|---|
| 4,137,579 | URINE DRAIN | Peter S. Soler |
| 4,683,598 | URINAL FOR USE BY FEMALES | Kathleen K. Jones |

The Soler patent discloses a urine drain having features similar to the applicant's invention herein. A drain line is attached to a receptacle member to receive urine therein. The receptacle member is attached to a fresh water supply source for flushing and rinsing subject receptacle member after usage.

The Jones patent discloses a urinal for use by females having a flexible tube with a flared upper end to conveniently fit around the vaginal area and collect urine which drains down the inside of the flexible tube to a collected bowl.

PREFERRED EMBODIMENT OF THE INVENTION

In one preferred embodiment of this invention, a hand held movable urinal assembly is operably connected with various elements of a toilet bowl assembly and is selectively grasped, moved, and utilized normally by a male person during a urinating operation.

The toilet bowl assembly is of a conventional nature having 1) a base flush reservoir assembly; 2) a water storage reservoir assembly secured to a rear upward portion of the base flush reservoir assembly; and 3) a fluid control and supply assembly operable to receive a fluid supply and control a toilet flushing operation in a coventional manner and being operably connected to the hand held movable urinal assembly.

The base flush reservoir assembly utilizes a toilet seat assembly mounted on a base reservoir member having a peripheral seat support flange operable to receive and support a portion of the hand held movable urinal assembly thereon.

The fluid control and supply assembly includes a water inlet line connected to a main float valve assembly to supply water thereto and having a handle which is pivotal during a flushing operation to control movement of the water in the water inlet line through the main float valve assembly in a substantially conventional manner during a toilet flushing operation.

The hand held movable urinal assembly includes 1) a flush fluid supply assembly operably connected to the water inlet line which is connected to the main float valve assembly; 2) a movable funnel receiver assembly which is operable to be releasably supported on a side wall of the water storage reservoir assembly of the toilet bowl assembly and connected to a fluid discharge line which is connected to the fluid inlet line; and 3) a discharge fluid flush assembly having a discharge hose member which is connected to a portion of the movable funnel receiver assembly. The discharge hose member is operable to convey the water and urine deposited within the movable funnel receiver assembly to an interior of the base reservoir member of the base flush reservoir assembly of the toilet bowl assembly which is subsequently removed during a conventional toilet bowl flushing operation.

On assembly of the hand held movable urinal assembly with the water inlet line in the toilet bowl assembly, the water inlet line, which is directed to the main float valve assembly, is severed and an adapter member, being a T-member of the fluid control and supply assembly, is connected thereto. One portion of the T or Y-shaped adapter member is connected through a fluid discharge line having an inlet connector section secured to the adapter member and an outlet connector section is connected to a portion of the movable funnel receiver assembly.

Further, the outlet connector section is connected to a discharge nozzle member having a spray tip section with spray openings operable to provide a complete flushing operation within the movable funnel receiver assembly as will be noted.

The movable funnel receiver assembly includes 1) a funnel support bracket operable to be attached and supported from a side wall and top surface of the storage tank member of the water storage reservoir assembly of the toilet bowl assembly; and 2) a funnel receiver assembly operable to be releasably connected and supported by the funnel support bracket.

The funnel support bracket includes a tank connector section of generally U-shape which is connected to a funnel support section of generally ring shape. The funnel support section has an open entrance portion which allows a discharge hose member attached to the funnel receiver assembly to move therethrough and operable to receive and support the funnel receiver assembly thereon.

The funnel receiver assembly includes a main body member having a funnel enclosure lid member pivotally connected thereto by a pivot hinge member.

The main body member is of generally tapered funnel shape including a top flange section integral with a downwardly, inwardly tapered wall section and having, integral therewith, a lower tube connector section.

The funnel enclosure lid member includes a lower flange section integral with a stepped mid section which, in turn, is integral with a nozzle connector section. The funnel enclosure lid member is adapted to be pivoted about the pivot hinge member to achieve an enclosed seal with the top flange section of the main body member when in the covered, enclosed condition. This sealing function is necessary for a flushing, cleansing operation of the main body member as will be noted.

The nozzle connector section has a central nozzle receiver hole operable to receive the discharge nozzle member with the outlet connector section of the fluid discharge line secured thereto.

The discharge nozzle member is placed through the nozzle receiver hole and positioned in a proper adjusted position to achieve an efficient flushing and cleansing operation therein in a manner to be explained.

The discharge fluid flush assembly includes 1) a discharge hose member having a connector end section mounted on the tube connector section of the main body member of the funnel receiver assembly; and 2) a bowl hose connector assembly connected to the seat support flange of the base reservoir member of the toilet bowl assembly. The discharge end portion of the discharge hose member is connected to the bowl hose connector assembly.

The bowl hose connector assembly includes a bowl bracket member having a pair of tube connector clips mounted thereon. More specifically, the bowl bracket member is of generally U-shape having an outer section integral with a mid section which, in turn, is integral with an inner section.

The mid section is operable to rest on a top surface of the seat support flange of the base reservoir member of the toilet bowl assembly. Outer surfaces of the outer section and inner section each have one of tube connector clips connected thereto.

The tube connector clips are of circular ring shape and operable to have the discharge end portion of the discharge hose member first trained upwardly through the tube connector clip on an outer surface of the outer section of the bowl bracket member. The discharge hose member is further trained upwardly, over, and down on the outer surface of the inner section of the bowl bracket member and placed through the tube connector clip thereon.

In the assembled condition of FIG. 1, it is noted that the movable funnel receiver assembly is connected to the fluid supply line to supply clean fluid thereto on each actuation of a handle member of the toilet bowl assembly during a toilet bowl flushing operation.

The movable funnel receiver assembly is operable to be grasped by a user thereof and the funnel enclosure lid member is moved to the opened condition whereupon the user can utilize same for a urinating function.

The urine fluid then flows by gravity downwardly through the discharge hose member and into an interior of the base reservoir member of the base flush reservoir assembly of the toilet bowl assembly for subsequent discharge therefrom.

The user would then pivot the funnel enclosure lid member to a closed condition and place the funnel receiver assembly on the funnel support bracket.

Next, the user would actuate the actuator handle assembly of the toilet bowl assembly in a conventional manner to initiate a normal flushing action within the water storage reservoir assembly of the toilet bowl assembly.

The flushing fluid would then flow through the main float valve assembly in a conventional manner and outwardly through the fluid discharge line and the discharge nozzle member to cause a cleansing or flushing action within the interior of the main body member of the funnel receiver assembly. This flushing action will continue as long as the main float valve assembly operates to fill up the storage tank member of the water storage reservoir assembly in a conventional manner.

OBJECTS OF THE INVENTION

One object of this invention is to provide a hand held movable urinal assembly which is readily and easily connected to a toilet bowl assembly having a funnel receiver assembly operable to receive a person's urine therein and connected to a main float valve assembly to provide clean water for flushing of the funnel receiver assembly concurrently with flushing of the toilet bowl assembly in a conventional manner.

Another object of this invention is to provide a hand held movable urinal assembly having 1) a flush fluid supply assembly connected to a fluid line supply connected to a main float valve assembly; 2) a movable funnel receiver assembly connected by a fluid discharge line to the main float valve assembly; and 3) a discharge fluid flush assembly connected to the movable funnel receiver assembly operable to transfer fluid material into a base reservoir member of the toilet bowl assembly for subsequent discharging of waste products therefrom in a conventional toilet bowl flushing operation.

One other object of this invention is to provide a hand held movable urinal assembly easily connectable to a toilet bowl assembly having 1) a flush fluid supply assembly having a fluid discharge line connected to an inlet water supply connected to a main float valve assembly; 2) a movable funnel receiver assembly connected to a fluid discharge line from the main float valve assembly; and 3) a discharge fluid flush assembly connected to the movable funnel receiver assembly by a discharge hose member whereby urine fluid is discharged into the movable funnel receiver assembly which is selectively operable to receive clean inlet water thereto during a flushing action to discharge the urine fluid and cleansing water downwardly through the discharge hose member into a base reservoir member of the toilet bowl assembly during a conventional handle actuated toilet bowl flushing operation.

Another object of this invention is to provide a hand held movable urinal assembly readily connectable to a toilet bowl assembly having 1) an adapter member operable to connect a fluid flow line to convey flushing discharge fluid from a main float valve assembly; 2) a movable funnel receiver assembly having a funnel support bracket mounted on a storage tank member on the toilet bowl assembly and a funnel receiver assembly releasably mounted within the funnel support bracket; 3) a discharge fluid flush assembly having a discharge hose member connected to a discharge outlet on the funnel receiver assembly; and 4) a bowl hose connector assembly having a bowl bracket member mounted on a base reservoir member of the toilet bowl assembly and operable to receive and support a discharge end portion of the discharge hose member which transfers fluids from the funnel receiver assembly into the base reservoir member during a conventional toilet bowl flushing operation on activation of a handle member.

Still, one other object of this invention is to provide a hand held movable urinal assembly which is readily and releasably connectable to a toilet bowl assembly which is economical to manufacture; easy to use as being releasably mounted on a funnel support bracket; connected to a fresh inlet water supply which is utilized in a flushing cleansing action during a normal toilet bowl flushing operation; flexible and easy to maneuver when being utilized in a urinal dispensing operation; sturdy in construction; and substantially maintenance free.

Various other objects, advantages, and features of the invention will become apparent to those skilled in the art from the following discussion, taken in conjunction with the accompanying drawings, in which:

FIGURES OF THE INVENTION

Figure 1:
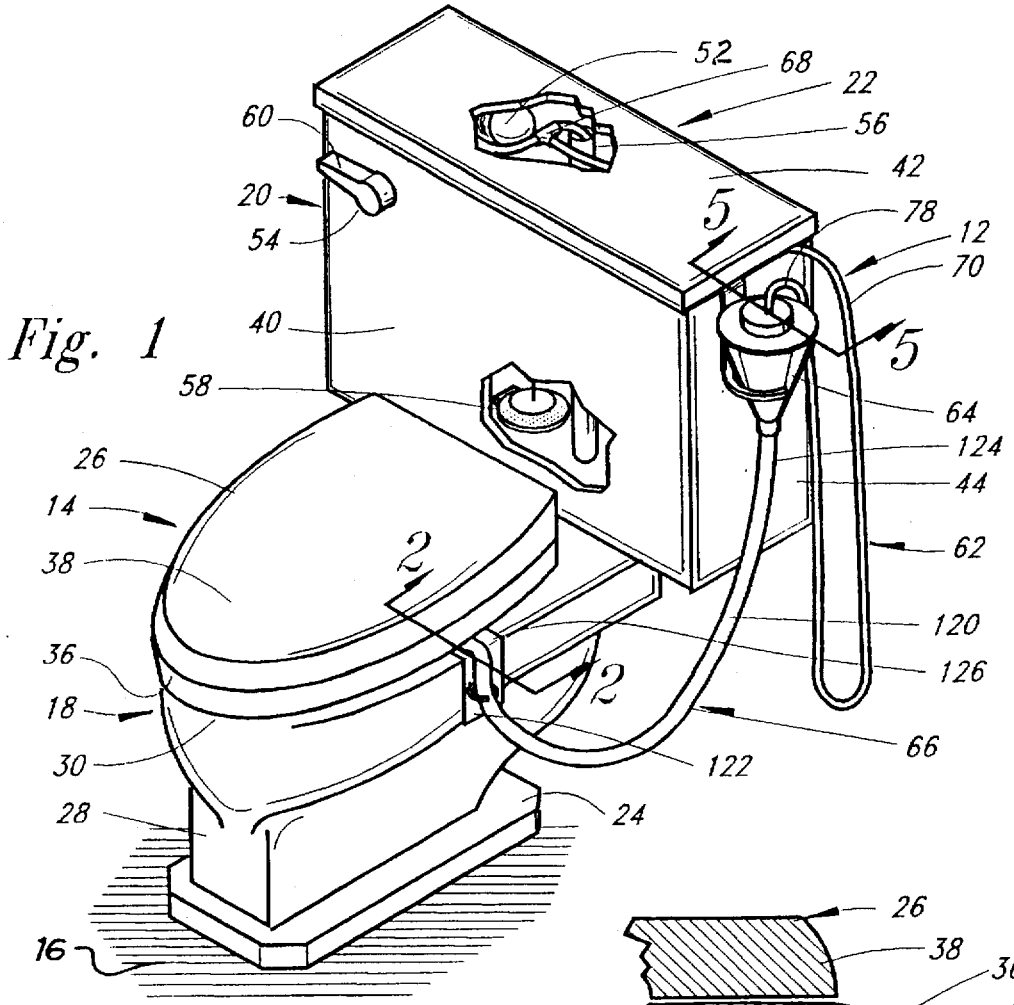
FIG. 1 is a perspective view of a toilet bowl assembly having a hand held movable urinal assembly of this invention mounted thereon.

The following is a discussion and description of preferred specific embodiments of the hand held movable urinal assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

On referring to the drawings in detail, and in particular to FIG. 1, a hand held movable urinal assembly of this invention, indicated generally at 12, is mounted on a toilet bowl assembly 14 secured in a conventional manner to a support surface 16 as normally found in a bathroom or restroom environment.

As noted in FIG. 1, the toilet bowl assembly 14 includes 1) a base flush reservoir assembly 18 mounted on the support surface 16; 2) a water storage reservoir assembly 20 mounted on a rear upper surface of the base flush reservoir assembly 18; and 3) a fluid control and supply assembly 22 connected to the water storage reservoir assembly 20 in a manner to be explained.

The base flush reservoir assembly 18 includes a base reservoir member 24 having a toilet seat assembly 26 pivotally connected to the base reservoir member 24 in a conventional manner.

The base reservoir member 24 includes 1) a connector base 28 secured to the support surface 16 with nut and bolt members in a known manner; 2) a seat support flange 30 extended about an upper periphery of the connector base 28; and 3) a side wall member 32 extended between the seat support flange 30 and the connector base 28.

The toilet seat assembly 26 is provided with 1) a seat base member 36 pivotally connected to the base reservoir member 24; and 2) an enclosure lid member 38 pivotally connected to the seat base member 36.

The seat base member 36 is pivotally connected by hinge members (not shown) to the enclosure lid member 38 whereupon the toilet seat assembly 26 is operable in a known conventional manner.

The water storage reservoir assembly 20 is provided with a main storage tank member 40 to receive flushing water therein and is mounted on a rear upper surface of the base reservoir member 24 and having a tank lid member 42 mounted over and around an open top area of the storage tank member 40.

The storage tank member 40 is provided with opposed end wall members 44 to receive and support a portion of the hand held movable urinal assembly 12 as will be explained.

The tank lid member 42 is provided with a top wall section 46 having an integral downwardly projecting peripheral flange section 48 to extend outwardly and about an outer surface of the storage tank member 40 in a known manner.

The fluid control and supply assembly 22 includes 1) a water inlet line (not shown) which is normally trained behind the base flush reservoir assembly 18 and through a hole within a bottom wall of the storage tank member 40; 2) a main float valve assembly 52 mounted within the storage tank member 40 is operably connected to the water inlet line; and 3) an actuator handle assembly 54 is connected to a front wall of the storage tank member 40 and operably connected to the main float valve assembly 52 with pivotal movement of the actuator handle assembly 54 actuating the main float valve assembly 52 in a conventional manner during a normal toilet bowl flushing operation.

The main float valve assembly 52 can be of various conventional types having 1) a drain tube member 56 into which a portion of the flushing water to be dispensed; and 2) a float valve member 58 which is operable to be lifted from sealing a discharge opening on pivotal movement of the actuator handle assembly 54 in a conventional manner.

The water stored within the storage tank member 40 on upward pivotal movement of the float valve member 58 allows a controlled amount of water therein to flow into the base reservoir member 24 of the base flush reservoir assembly 18 to provide a normal toilet bowl flushing operation.

The toilet bowl assembly 14 operates in a conventional manner during the toilet bowl flushing operation in that pivotal movement of the actuator handle assembly 54 causes, through an attached lever and chain member, to raise the float valve member 58.

At this time, water flows from the water inlet line through the main float valve assembly 52 with a portion thereof directed into the drain tube member 56 which supplies flushing fluid about an upper periphery inside the base reservoir member 24.

After a substantial amount of water has been drained from the storage tank member 40 of the water storage reservoir assembly 20, the float valve member 58 then moves under gravity to a closed condition to prevent the water flow from the storage tank member 40.

The water level then increases in the storage tank member 40 but water continues to flow with a limited amount into the drain tube member 56 which tends to fill up the base reservoir member 24 to a predetermined level.

There is a conventional float rod and float ball connected to the main float valve assembly 52 in a conventional manner which operates to cease all fluid flow out of the main float valve assembly 52 when a predetermined fluid level is obtained within the storage tank member 40.

The hand held movable urinal assembly 12 includes 1) a flush fluid supply assembly 62 having a portion thereof connected to the main float valve assembly 52; 2) a movable funnel receiver assembly 64 being removably mounted on a portion of the water storage reservoir assembly 20 of the toilet bowl assembly 14; and 3) a discharge fluid flush assembly 66 operably connected to a discharge portion of the movable funnel receiver assembly 64 and to the interior of the base reservoir member 24 of the base flush reservoir assembly 18 of the toilet bowl assembly 14.

The flush fluid supply assembly 62 is provided with an adapter member 68 of T-shape having one portion thereof connected to a fluid supply line 69 and a second portion connected to a fluid discharge line 70 which is connected to the movable funnel receiver assembly 64 as will be noted.

The adapter member 68 is provided with tube receiver ends 74, namely three thereof, operable to be connected to the fluid supply line 69, the fluid discharge line 70, and a flush discharge line 71. The flush discharge line 71 is directed into the drain tube member 56 of the main float valve assembly 52.

The fluid discharge line 70 has an inlet connector section 76 connected to the adapter member 68 and an outlet connector section 78 which is connected to a discharge nozzle member 72. The discharge nozzle member 72 is mounted within an opening in the movable funnel receiver assembly 64 for a flushing operation in a manner to be described.

The discharge nozzle member 72 is provided with an outer spray tip section 80 having a plurality of spaced spray openings 82. At least four of the spray openings 82 are provided which project a fanned spray therefrom for a cleansing operation of the movable funnel receiver assembly 64.

Figure 5:
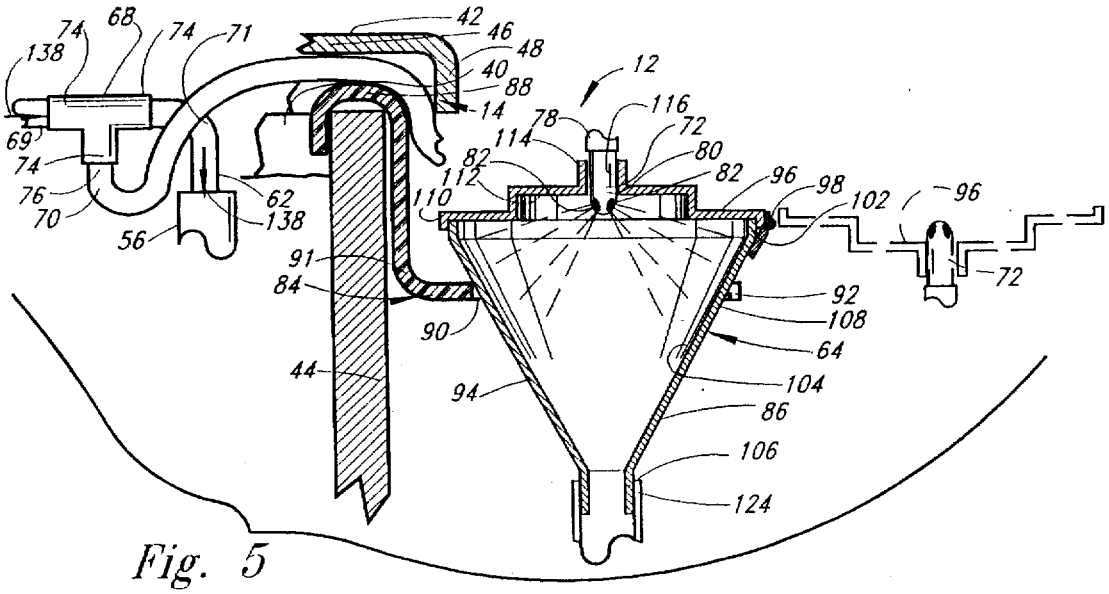
FIG. 5 is an enlarged fragmentary sectional view taken along line 5—5 in FIG. 1.

As best shown in FIG. 5, the movable funnel receiver assembly 64 includes 1) a funnel support bracket 84 operable to be releasably connected to one of the end wall members 44 of the storage tank member 40; and 2) a funnel receiver assembly 86 connected to the outlet connector section 78 and discharge nozzle member 72 of the flush fluid supply assembly 62 and releasably connected to the funnel support bracket 84.

The funnel support bracket 84 includes a tank connector section 88 of generally L-shape which is integral with a connector leg 91 which, in turn, is integral with a funnel support section 90 of generally circular ring shape.

As noted in FIG. 5, the tank connector section 88 is adapted to be placed over and about a top wall of the end wall member 44 of the water storage tank reservoir assembly 20.

The funnel support section 90 is of a ring plate construction having an open entrance portion 92 of a size sufficient to permit a discharge hose member be trained therethrough in a manner to be described.

The funnel receiver assembly 86 includes a funnel shaped main body member 94 having a funnel enclosure lid member 96 pivotally connected thereto by a pivot hinge member 98.

The main body member 94 includes a top flange section 102 integral with an inwardly tapered wall section 104 which, in turn, is integral with a lower tube connector section 106.

Figure 6:
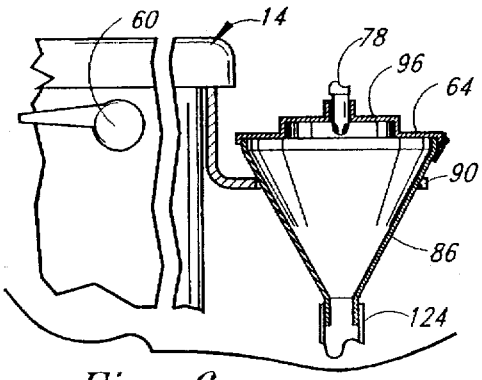
FIG. 6 is a view similar to FIG. 5.
Figure 8:
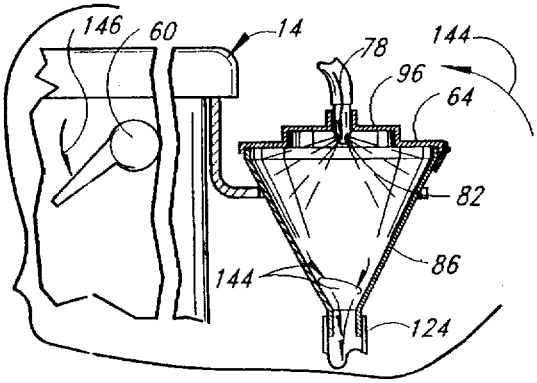
FIG. 8 is a view similar to FIG. 6 illustrating a flushing operation used to flush and cleanse a funnel receiver assembly of this invention.

A top surface of the top flange section 102 is operable to be in sealing engagement with a portion of the funnel enclosure lid member 96 when in the closed condition as noted in FIGS. 5, 6, and 8.

The tapered wall section 104 is provided with an outer tapered support surface 108 operable to engage an inner portion of the funnel support section 90 of the funnel support bracket 84 when held thereunder by the force of gravity.

The funnel enclosure lid member 96 is provided with a lower flange section 110 integral with a stepped mid section 112 which, in turn, is integral with a nozzle connector section 114.

The nozzle connector section 114 is provided with a nozzle receiver hole 116 to receive the discharge nozzle member 72 therein. The discharge nozzle member 72 is adjustable axially so as to be positioned properly to achieve an efficient and effective cleansing operation as noted in FIG. 8.

As noted in FIG. 1, the discharge fluid flush assembly 66 is provided with an elongated discharge hose member 120 operable to have a lower discharge end releasably connected to a bowl hose connector assembly 122.

The discharge hose member 120 is provided with a connector end portion 124 mounted in a sealing manner with the lower tube connector section 106 of the main body member 94 and a lower discharge end portion 126 which is trained through the bowl hose connector assembly 122. The discharge end portion 126 has an outlet opening positioned inwardly and downwardly of the seat support flange 30 of the base reservoir member 24 of the toilet bowl assembly 14.

Figure 2:
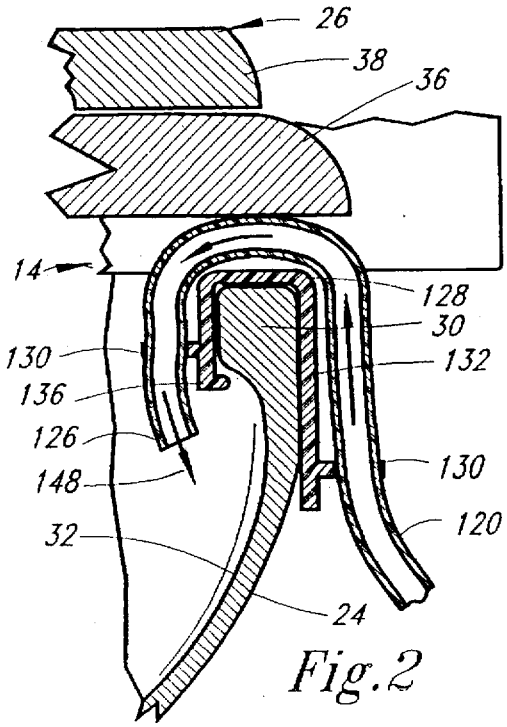
FIG. 2 is an enlarged fragmentary sectional view taken along line 2—2 in FIG. 1.
Figure 3:
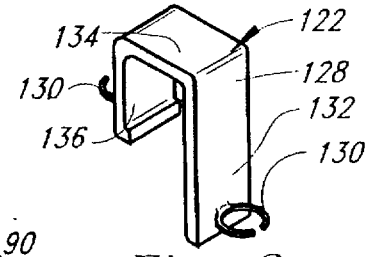
FIG. 3 is a perspective view of a toilet bowl bracket member.
Figure 4:
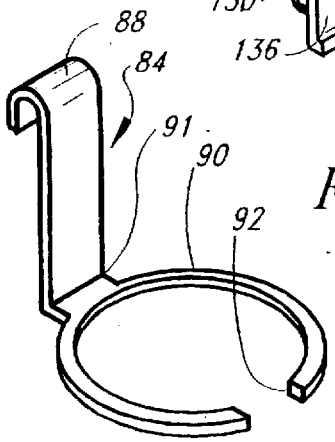
FIG. 4 is a perspective view of a funnel support bracket.

As shown in FIGS. 2 and 3 collectively, the bowl hose connector assembly 122 includes a bowl bracket member 128 having a pair of laterally extended tube connector clips 130 thereon. The bowl bracket member 128 is of generally J-shape having an outer section 132 integral with a mid section 134 which, in turn, is integral with an inner section 136.

The mid section 134 is operable to be placed and supported on a top surface of the seat support flange 30 of the base reservoir member 24.

One tube connector clip 130 extends from an outer surface of the outer section 132 and another one extends laterally from an outer surface of the inner section 136.

Each tube connector clip 130 is of a circular ring shape and having an opening between two elements thereof to allow the discharge hose member 120 to be pressed laterally of the opening. The discharge hose member 120 can be trained upwardly through the outer tube connector clip 130, over the top surface of the mid section 134, and trained through the tube connector clip 130 on the inner section 136 as noted in FIG. 2.

Therefore, it is obvious that any fluid to be discharged through the discharge hose member 120 and, more specifically, the discharge end portion 126 would be deposited within the inner confines of the base reservoir member 24 of the base flush reservoir assembly 18.

USE AND OPERATION OF THE INVENTION

In the use and operation of the hand held movable urinal assembly 12 of this invention, it is operable to easily and readily be attached to a conventional toilet bowl assembly 14. The only tool to be required would be a sharp knife in order to cut plastic tubing in a manner to be explained.

The fluid supply line 69 would normally be found extended into the drain tube member 56 of the main float valve assembly 52.

The flush fluid supply assembly 62 is utilized with the adapter member 68 and the fluid discharge line 70 of the same size and tubular construction as the fluid supply line 69.

The fluid discharge line 70 has an inlet connector section 76 connected to the third tube receiver end 74 of the adapter member 68 as noted in FIG. 5. The fluid discharge line 70 is directed across a top area of the storage tank member 40 of the water storage reservoir assembly 20 which is enclosed by the tank lid member 42.

The fluid discharge line 70 has the outlet connector section 78 which is connected to the discharge nozzle member 72 which is mounted within the nozzle receiver hole 116 in the funnel encloser lid member 96. It is noted that a substantial length of the fluid discharge line 70 is allowed to extend outwardly, downwardly, and back upwardly to the connection to the movable funnel receiver assembly 64 so that it can be moved substantially laterally and vertically during usage thereof as will be noted.

The movable funnel receiver assembly 64 is then utilized having the funnel support bracket 84 with the tank connector section 88 placed on and about a top surface of the upper end wall member 44 of the storage tank member 40 as best noted in FIG. 5. Next, the funnel receiver assembly 86 is operable to be mounted within the funnel support section 90.

It is noted that the funnel enclosure lid member 96 is normally in a non-usage condition as placed in a closed condition after each use as will be explained.

The discharge fluid flush assembly 66 is then utilized whereupon the bowl hose connector assembly 122, through the bowl bracket member 128, is then mounted on the seat support flange 30 of the base reservoir member 24 as noted in FIG. 2.

Next, the connector end portion 124 of the discharge hose member 120 is connected to the lower tube connector section 106 of the main body member 94 of the funnel receiver assembly 86 as noted in FIG. 5.

An outer discharge end portion 126 of the discharge hose member 120 is then trained through the outer one of the tube connector clips 130 over the mid section 134 of the bowl bracket member 128, and through the second tube connector clip 130 on the inner section 136. This places the outer discharge end portion 126 within the inner confines of the base reservoir member 24 so that any fluids discharged through the discharge hose member 120 will be contained therein during a toilet bowl flushing operation as will be noted.

On use of the hand held movable urinal assembly 12, the user would first grasp the funnel receiver assembly 86 and having the discharge hose member 120 moved outwardly and transversely through the open entrance portion 92 of the funnel support section 90 of the funnel support bracket 84.

Figure 7:
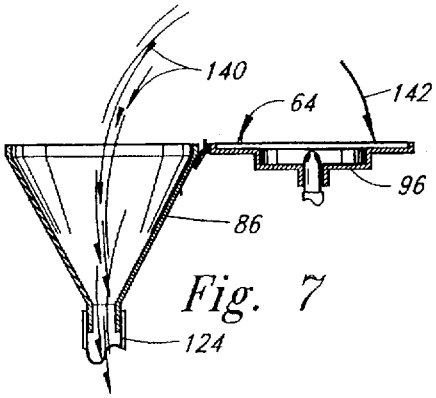
FIG. 7 is a schematic diagram illustrating use of the hand held movable urinal assembly of this invention during a urinating operation.

The user would then pivot the funnel enclosure lid member 96 to the open condition as shown in dotted lines in FIGS. 5 and 7. Next, the user would complete a urinating function as noted by arrows 140 in FIG. 7.

After this urinating function is completed, the user thereof would pivot the funnel enclosure lid member 96 to the closed condition as noted by an arrow 144 in FIG. 8. Then, the enclosed movable funnel receiver assembly 64 would be mounted and supported on the funnel support section 90 as noted in FIG. 6.

Next, the user would utilize the handle member 60 and pivot the same downwardly as noted by an arrow 146 in FIG. 8. Movement of the handle member 60 would initiate a toilet bowl flushing operation in a conventional manner as through a lever and chain member connected to the float valve member 58.

The float valve member 58 would be pivoted upwardly off a discharge opening. The water fluid in the storage tank member 40 would then be discharged under gravity into the base reservoir member 24 through the discharge opening.

Concurrently, the water fluid supply to the main float valve assembly 52 would continue to send fluid in the normal manner from the fluid supply line 69 transversely of the adapter member 68 for discharge into the drain tube member 56 as noted by an arrow 138 (FIG. 5).

Concurrently, fluid would then flow through the fluid discharge line 70, the outlet connector section 78, and the discharge nozzle member 72 for a fluid spray through the spray openings 82 as noted in FIG. 8.

As noted in FIG. 8, this water flow spreads outwardly in order to contact inner tapered walls of the tapered wall section 104 of the main body member 94 of the funnel receiver assembly Concurrently, the water level drops within the storage tank member 40 to a lower level whereupon the float valve member 58 pivots under gravity to close the discharge opening thereunder. This causes the water level to rise within the storage tank member 40 of the water storage reservoir assembly 20.

However, at this time, water continues to flow from the adapter member 68 into the drain tube member 56 and, concurrently, through the fluid discharge line 70 and the discharge nozzle member 72 to complete the flushing cleansing action within the funnel receiver assembly 86.

The main float valve assembly 52 is connected to a float rod and ball member (not shown) within the storage tank member 40 which operates in a conventional manner. When a certain predetermined fluid level is achieved within the storage tank member 40, this operates to cease any fluid flow within the fluid supply line 69. This ceases both the flushing action within the toilet bowl assembly 14 and within the funnel receiver assembly 86.

It is seen that this toilet bowl flushing operation automatically cleanses the funnel receiver assembly 86 and the discharge hose member 120 so that the entire system is now ready for proceeding with another mode of operation as previously discussed.

The use of the hand held movable urinal assembly 12 is recognized as having a means of a completeing a urinating function without any possibility of contamination of the toilet seat assembly 26 including the seat base member 36 and the enclosure lid assembly 38 mounted thereon. Further, the toilet seat assembly 26 will not have to be pivoted upwardly to complete this urinating function by a man and, thus, is greatly appreciated by ladies.

The hand held movable urinal assembly of this invention is easy to use; readily installed with a minimum amount of skill and tools required; economical to manufacture; presenting an automatic cleansing function; and substantially maintenance free.

While the invention has been described in conjunction with preferred specific embodiments thereof, it will be understood that this description is intended to illustrate and not to limit the scope of the invention, which is defined by the following claims:

I claim:

1. A urinal receiver and discharge assembly, comprising:

a) a toilet bowl assembly including a fluid control and supply assembly having a fluid inlet line connected to a main float valve assembly;

b) a flush fluid supply assembly includes a fluid discharge line connected to said main float valve assembly to receive fluid from said fluid inlet line during a flushing actuation of said main float valve assembly;

c) a funnel receiver assembly connected to said fluid discharge line operable to selectively receive the fluid therein during the flushing actuation of said main float valve assembly;

d) a discharge hose member connected to said funnel receiver assembly to receive and transfer all fluids received in said funnel receiver assembly to a receive reservoir;

e) said funnel receiver assembly includes a main body member having a funnel enclosure lid member pivotally connected thereto; and f) said fluid discharge line mounted through a receiver hole in said funnel enclosure lid member operable to discharge the fluid within said main body member during the flushing actuation.

2. A urinal receiver and discharge assembly as described in claim 1, wherein:

a) said flush fluid supply assembly includes a discharge nozzle member connected to an outer connector section of said fluid discharge line.

3. A urinal receiver and discharge assembly as described in claim 1, wherein:

a) said funnel enclosure lid member having a flange section mounted about an upper edge of a top flange section of said main body member to form a fluid seal therewith.

4. A hand held movable urinal assembly operable to be connected to a toilet bowl assembly, comprising:

a) a flush fluid supply assembly having a fluid discharge line operable to receive and transfer a flushing fluid from the toilet bowl assembly;

b) a movable funnel receiver assembly having a portion connected to said fluid discharge line;

c) a discharge fluid flush assembly including a discharge hose member having one end connected to said movable funnel receiver assembly and a second end operable to be mounted in a base reservoir member of the toilet bowl assembly;

d) said movable funnel receiver assembly includes a funnel receiver assembly having a main body member with a funnel enclosure lid member connected thereto;

e) said funnel enclosure lid member having an opening therein to receive one end of said fluid discharge line;

f) said funnel enclosure lid member is movable to an open condition in order to receive urine material therein and subsequently moved to a closed condition operable to receive the flushing fluid therein during a toilet bowl flushing operation to remove the urine material with the flushing fluid;

g) said fluid discharge line having a discharge nozzle member mounted on an outer end thereof; and h) said discharge nozzle member extended inwardly of an inner surface of said funnel enclosure lid member and having a spray opening operable to dispense the flushing fluid in a complete cleaning of said main body member and said discharge hose member during a toilet bowl flushing operation;

whereby urine material can be deposited in said movable funnel receiver assembly and the flushing fluid is selectively operable to move through said fluid discharge line into said movable funnel receiver assembly and discharged into said discharge hose member for final deposit into the base reservoir member which removes all of the urine material from said movable funnel receiver assembly and said discharge hose member.

5. A urinal receiver and discharge assembly as described in claim 4, wherein:

a) said funnel enclosure lid member having a flange section mounted about an upper edge of a top flange section of said main body member to form a fluid seal therewith.

* * * * *